US005622119A

United States Patent [19]

Hsieh

[11] Patent Number: 5,622,119

[45] Date of Patent: Apr. 22, 1997

[54] FOLDABLE COMPUTER TABLE

[76] Inventor: Chih-Hsin Hsieh, No. 54-1, Hong Dau, San Hsia Town, Taipei Hsien, Taiwan

[21] Appl. No.: 518,304

[22] Filed: Aug. 23, 1995

[51] Int. Cl.[6] ..... A47B 3/00

[52] U.S. Cl. ..... 108/115; 108/38

[58] Field of Search ..... 108/115, 34, 35, 108/36, 38, 108; 211/150, 195, 130; 248/291

[56] References Cited

U.S. PATENT DOCUMENTS

| | | | |
|---|---|---|---|
| 845,917 | 3/1907 | Worley et al. | 108/108 X |
| 2,473,022 | 6/1949 | Fenske, Jr. | 108/38 X |
| 3,436,092 | 4/1969 | Werner | 108/115 X |
| 3,525,492 | 8/1970 | Freidman | 108/115 X |
| 4,310,207 | 1/1982 | Adams, Jr. | 108/38 X |
| 5,022,539 | 6/1991 | Rushing et al. | 108/108 X |

*Primary Examiner*—Jose V. Chen
*Attorney, Agent, or Firm*—Bacon & Thomas

[57] ABSTRACT

A foldable computer table which can be folded to a minimium volume for easy storage and transport. The foldable computer table mainly includes a top board, a back board, two side wall panels, and two legs. The top board and the legs are pivotally connected to the side wall panels at. Three different holding devices are separately provided on the side wall panels and the back board, to hold the folded top board and the folded and extended legs in place.

4 Claims, 5 Drawing Sheets

FOLDABLE COMPUTER TABLE

BACKGROUND OF THE INVENTION

The present invention relates to a foldable computer table, and more particularly to a computer table which can be easily extended for convenient use or folded to occupy a very small room for convenient storage and transportation.

The current industry in Taiwan has been upgraded from a labor-intensive stage to a capital- and technique-intensive stage, all the products manufactured at this new stage are technically-oriented to achieve higher quality and added value and therefore to share the largest market. To achieve this target, it has become a common goal of all industries to develop completely new products to promote the market.

Most of the presently commercially available computer tables are of knockdown type in consideration of convenient transport. These conventional knockdown computer tables are disassembled so that main parts or members thereof are packed separately before they are transported to a certain destination for sale. There are still many accessories or spare parts, such as screws, and tools for assembling, such as screw drivers, to be prepared to successfully complete the assembly next time when the computer tables are to be used.

The following disadvantages are found in the above-mentioned knockdown type computer tables:

1. Even in a disassembled condition, the main parts or members of these conventional knockdown computer tables together occupy considerable space and therefore can not reduce the cost for transporting them.

2. The disassembled computer tables must be assembled again for use and screws and screw drivers are usually required to complete the assembly. In the event the screws supplied with the disassembled computer tables are unfortunately missed, or no screw drivers are available at the site of assembly, the assembly of the computer tables would be interrupted.

3. The assembled computer tables have fixed a volume and therefore occupy a fixed space. When the computer tables are to be stored or to be transported to some other place again, they must be disassembled again to save or reduce the occupied space as much as possible. It is surely time and labor intensive to disassemble and re-assemble the computer tables each time they are to be transported.

Therefore, it is desirable to develop a foldable computer table which can be easily and conveniently folded for transport or be extended for use.

SUMMARY OF THE INVENTION

It is therefore a primary object of the present invention to provide a foldable computer table which can be folded to minimize its volume for convenient storage and transport and will therefore, require fewer storage and transport costs.

Another object of the present invention is to provide foldable computer table which can be easily extended from a folded, volume-reduced status simply by reversing the folding steps. Neither the folding nor the extending of the computer table requires any tool or accessory.

BRIEF DESCRIPTION OF THE DRAWINGS

The above and other objects and the structure and features of the present invention, as well as the technical means adopted to achieve such objects and features can be best understood by referring to the following detailed description of the preferred embodiment and the accompanying drawings, wherein

FIGS. 4 and 4A illustrate the manner in which the table legs are returned from the backside of the back board and held to a lower front thereof.

DETAILED DESCRIPTION OF THE PREFERRED EMBODIMENT

As shown in FIGS. 1 to 4, the present invention is a foldable computer table mainly including an L-shaped back board 1, a reverse L-shaped top board 2, a pair of legs 3 connected by a transom, and two side wall panels 4.

Figure 5:
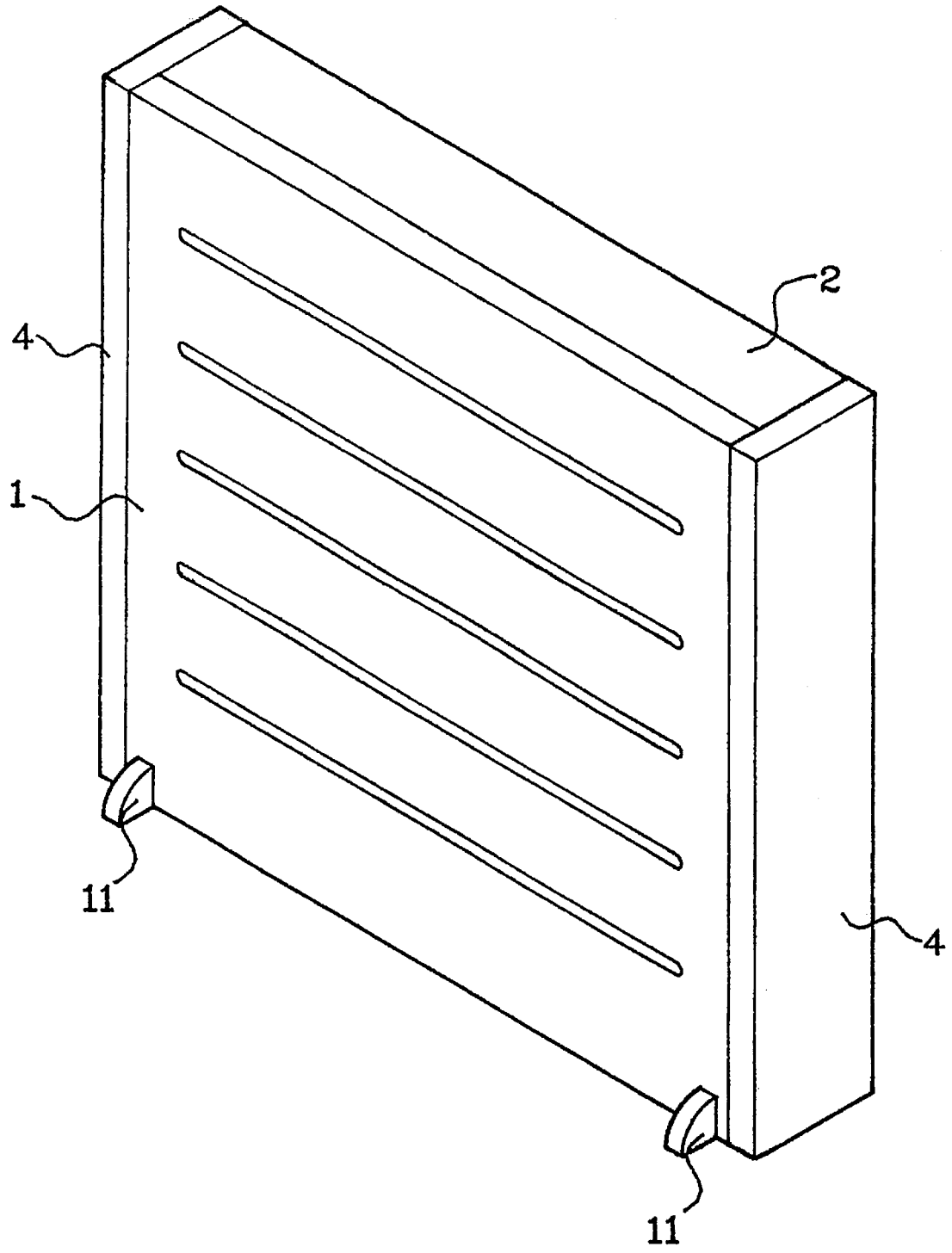
FIG. 5 is a perspective view showing the foldable computer table in a completely folded status.

The L-shaped back board 1 has a longer vertical supporting part and a shorter horizontal bottom part. Two forward projected stabilizers 11 are symmetrically screwed to two lower front corners of the vertical supporting part of the L-shaped back board 1 so that the completely folded computer table of the present invention, as shown in FIG. 5, can be stably positioned uprightly.

The two side wall panels 4 are fixedly attached to two lateral sides of the back board 1 and extend backward therefrom to, together with the back board 1, define a back space 5 therebetween. On each side wall panel 4, there is provided a top pivot 41 connected with a rear end portion of the top board 2 and a bottom pivot 42 connected with a rear end of the leg 3. A first and a second holding means 43, 44 are provided on each side wall panel 4. A third holding means 45 is centered at a lower front edge of the back board 1 above the transom between the legs 3.

Figures 2, 2A:
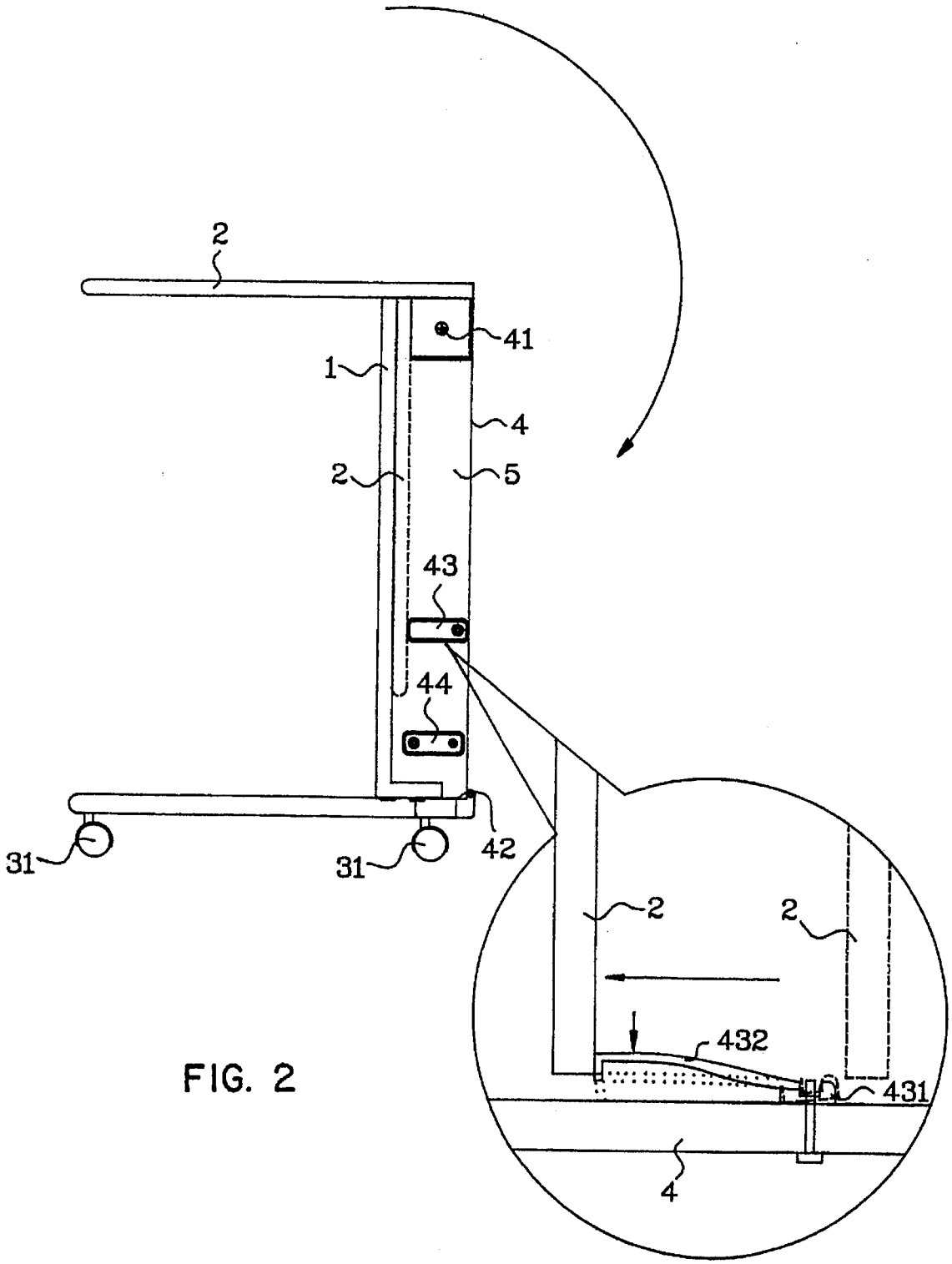
FIGS. 2 and 2A illustrate the manner in which the table top is folded toward and held to a backside of a back board of the present invention.

The first holding means 43 is located near a lower portion of the side wall panel 4 and has a fixed shaft 431 and a substantially L-shaped and slightly curved holding member 432 extending forward from the fixed shaft 431, as shown in FIG. 2A. When the top board 2 is pivotally turned upward about the top pivots 41 toward the back side of the back board 1, it will pass the fixed shafts 431 of the two first holding means 43 fixed to the two side wall panels 4 and engage with the holding members 432. The holding members 432 are depressed by the top board 2 to allow the latter to pass them and be held in front of the holding members 432 and be received in the back space 5 when the holding members 432 return to their original projected positions. To extend the top board 2 again, just depress the holding members 432 by fingers to allow the top board 2 to pass over the holding members 432 and be turned about the pivots 41 to the desired position.

Figures 3, 3A:
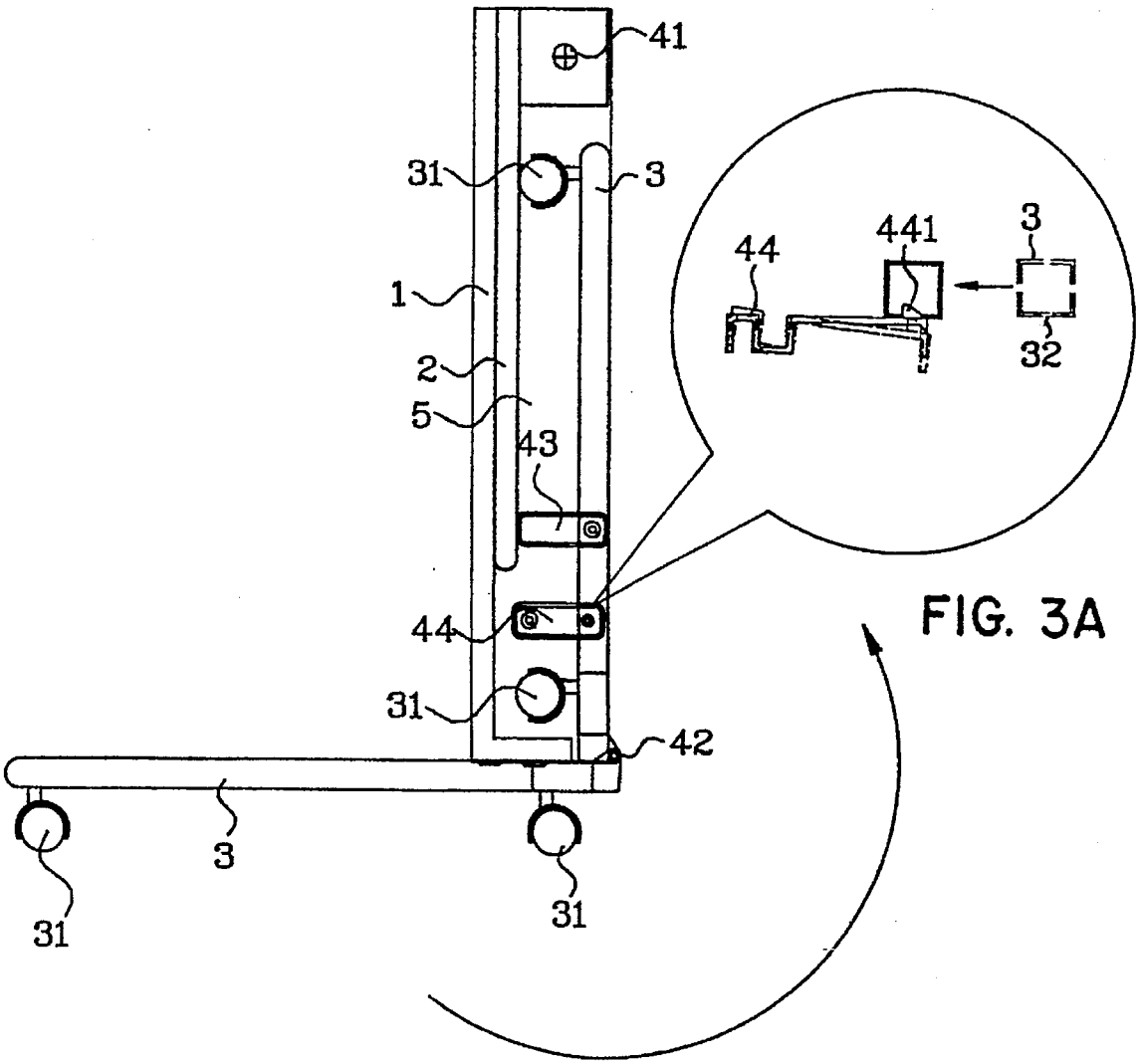
FIGS. 3 and 3A illustrate the manner in which the table legs are folded toward and held to the backside of the back board of the present invention.

The bottom pivot 42 is provided at each lower rear end of the side wall panel 4 to pivotally connect one leg 3, so that the leg 3 can be turned downward about the bottom pivot 42 toward the back side of the back board 1 and be received in the back space 5, as shown in FIG. 3.

The second holding means 44 is located near the lower portion of the side wall panel 4 lower than the first holding means 43 and has a substantially step-shaped cross section, as shown in FIG. 3A, for allowing a long rear position thereof to be depressed under pressure. A projection 441 having a backward and downward inclined surface is formed near a rear end of the second holding means 44. When the leg 3 is pivotally turned downward about the bottom pivot 42 toward the back side of the back board 1, it will pass the second holding means 44 with an opening 32 formed on the leg 3 engaging with the projection 441 of the second holding means 44, causing the leg 3 to be held in place. To release and extend the leg 3 to its original position, just pull the leg 3 backward and the flexibility of the second holding means 44 would automatically release the leg 3 therefrom.

Figure 4:
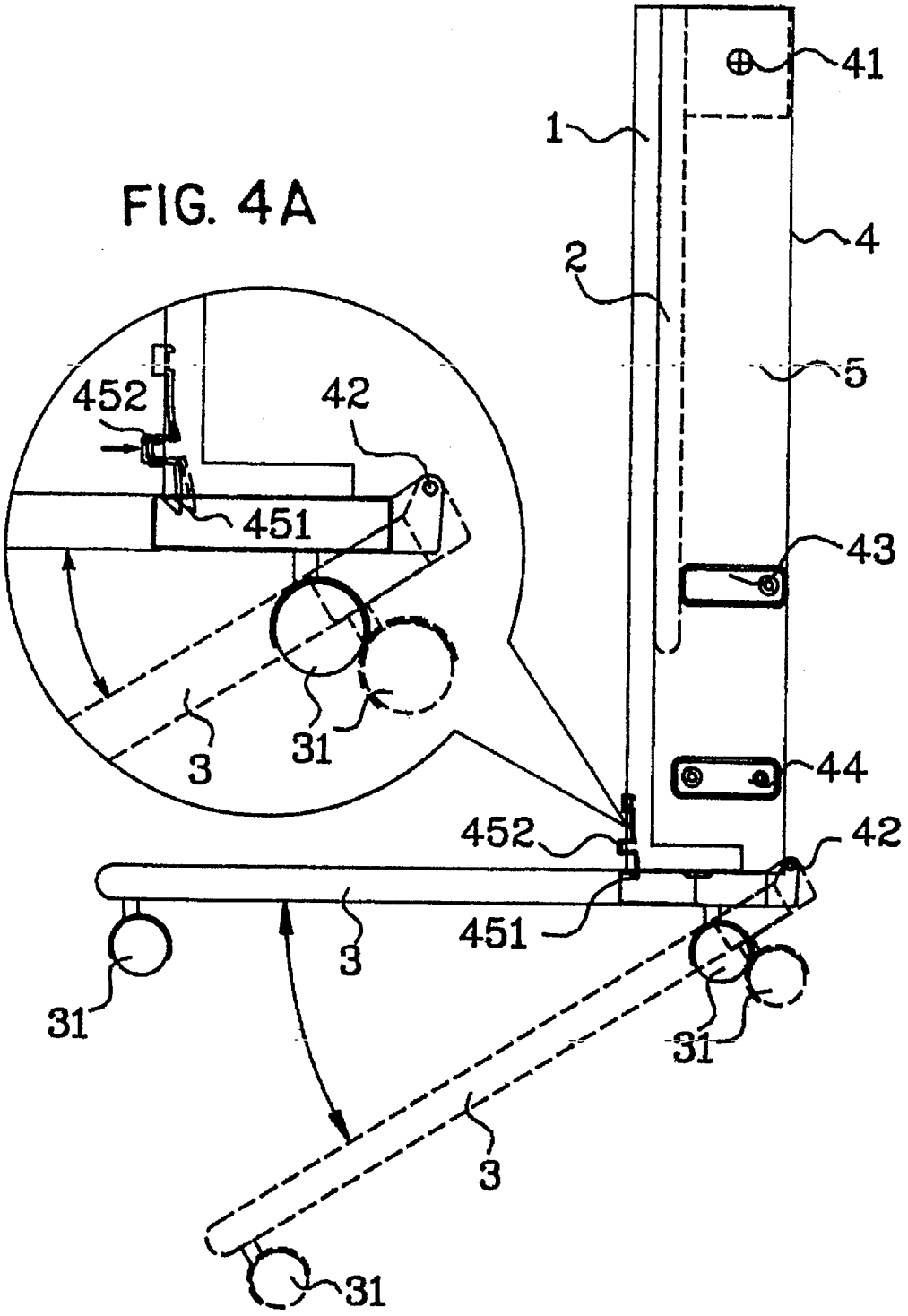

Please refer to FIGS. 4 and 4A, the third holding means 45 is provided near a middle point of the lower front edge of the back board 1 immediately above the transom between the two legs 3. The third holding means 45 has a lower hook portion 451 which may extend into and engage with a hole formed on the transom of the legs 3 when the latter are in their fully extended position, so that the legs 3 are firmly retained to the back board 1, and an upper projection 452 adequately projected forward from the lower front edge of the back board 1. To release the hook portion of the third holding means 45 from the transom of the legs 3, just depress by fingers the upper projection 452 of the third holding means 45.

Figure 1:
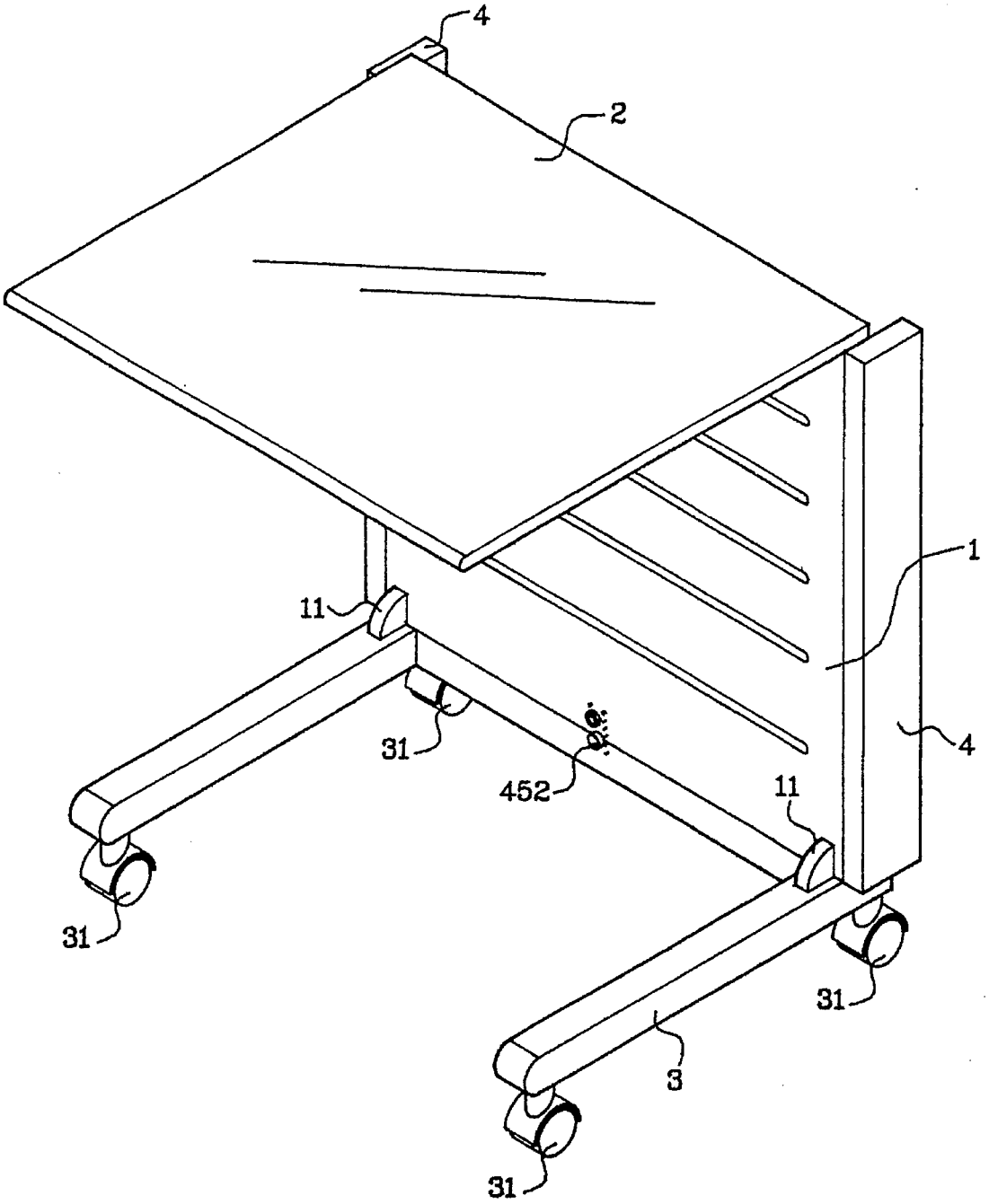
FIG. 1 is a perspective view showing the foldable computer table according to the present invention.

FIG. 5 illustrates the present invention in a completely folded status which looks like a flat case. To extend the folded flat case as shown in FIG. 5 to a computer table ready for use as shown in FIG. 1, just reverse the steps for folding the computer table.

With the above arrangements, the computer table of the present invention can be easily folded to a minimium volume to occupy only very small space for convenient storage and transport, and can be easily extended again for use. Many tests have been conducted on prototypes of the present invention and the test results indicate that the computer table of the present invention has a simple but practical and functional structure.

It is to be understood that the form of the invention shown and disclosed is to be taken as a preferred embodiment of the invention and that various changes in the shape, size, and arrangement of parts may be resorted to without departing from the spirit of the invention or the scope of the subjoined claims.

What is claimed is:

1. A foldable computer table comprising:

a) an L-shaped back board having a front face, a rear face, a lower front edge, an upper front edge and a pair of lateral sides;

b) a pair of side wall panels secured to the lateral sides of the back board, the side wall panels and the rear face of the back board collectively defining a back space, and each side wall panel including a top portion and a bottom portion;

c) a reverse L-shaped top board pivotally secured to the top portions of the side wall panels for pivotal movement between an extended position, wherein the top board extends horizontally from the upper front edge of the back board, and a folded position, wherein the top board is disposed in the back space adjacent the rear face of the back board;

d) a first holding means for maintaining the top board in its folded position;

e) a pair of legs pivotally connected to the bottom portions of the side wall panels for pivotal movement between an extended position, wherein the legs extend forwardly of the front face of the back board, and a folded position, wherein the legs are disposed within the back space;

f) a second holding means for maintaining the legs in the folded position; and g) a third holding means at the lower front edge of the back board for maintaining the legs in the extended position.

2. The foldable computer table of claim 1 wherein the first holding means includes:

a) a fixed shaft mounted on an inner face of each side wall panel; and b) an L-shaped and curved resilient holding member extending forwardly from each fixed shaft.

3. The foldable computer table of claim 1 wherein the second holding means includes:

a) a resilient step-shaped holding member mounted to an inner face of each side wall panel;

b) the holding member includes a depressible rear portion; and c) a triangular projection having a backward and downward inclined surface formed on an outer surface of the rear portion.

4. The foldable computer table of claim 1 wherein the third holding means includes:

a) a repressible forward projection mounted at the lower front edge of the back board, the projection including a lower hook portion extending downwardly therefrom;

b) a transom connecting the legs together and a hole formed in the transom; and c) the hole being engageable by the hook projection for maintaining the legs in the extended position.

* * * * *